US006606109B1

(12) United States Patent
Takizawa et al.

(10) Patent No.: US 6,606,109 B1
(45) Date of Patent: Aug. 12, 2003

(54) THERMAL HEAD AND THERMAL HEAD UNIT

(75) Inventors: Osamu Takizawa, Chiba (JP); Norimitsu Sambongi, Chiba (JP); Noriyoshi Shoji, Chiba (JP); Yuji Nakamura, Chiba (JP); Taro Ito, Chiba (JP); Yumiko Yamaguchi, Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 09/762,556

(22) PCT Filed: Aug. 9, 1999

(86) PCT No.: PCT/JP99/04318

§ 371 (c)(1),
(2), (4) Date: Apr. 6, 2001

(87) PCT Pub. No.: WO00/09340

PCT Pub. Date: Feb. 24, 2000

(30) Foreign Application Priority Data

Aug. 11, 1998 (JP) ..... 10-227104
Aug. 20, 1998 (JP) ..... 10-234603

(51) Int. Cl.[7] ..... B41J 2/335

(52) U.S. Cl. ..... 347/208

(58) Field of Search ..... 347/200, 208

(56) References Cited

FOREIGN PATENT DOCUMENTS

| | | |
|---|---|---|
| EP | 0491388 | 6/1992 |
| EP | 0604816 | 7/1994 |

OTHER PUBLICATIONS

Patent Abstracts of Japan, vol. 012, No. 141 (M–691), Apr. 28, 1988 publication No. 61141572, publication date Jun. 28, 1986.

Patent Abstracts of Japan, vol. 010, No. 336 (M–535), Nov. 14, 1986 publication No. 62259876, publication date Nov. 12, 1987.

Patent Abstracts of Japan, vol. 006, No. 204 (M–164), Oct. 15, 1982 publication No. 57109674, publication date Jul. 8, 1982.

*Primary Examiner*—Huan Tran
(74) *Attorney, Agent, or Firm*—Adams & Wilks

(57) ABSTRACT

A thermal head and a thermal head unit are provided, which can prevent density variation while suppressing the size of the thermal head to be small. In a thermal head (10) having a head chip (20) having one surface on which heat generating elements and segment and common electrodes connected to the heat generating elements are provided, and an IC chip (32) connected to the segment electrodes, the common electrode (27) provided to the head chip (20) is elongated in an array direction of the heat generating elements, and connections between the common electrode (27) and common electrode wirings (41) are provided at plural locations along the array direction.

18 Claims, 9 Drawing Sheets

(a)

(b)

(a)

(b)

(a)

(b)

THERMAL HEAD AND THERMAL HEAD UNIT

CROSS-REFERENCE TO RELATED APPLICATIONS

This application is U.S. national stage application of copending International Application Ser. No. PCT/JP99/04318, filed on Aug. 9, 1999 and published in a non-English language.

TECHNICAL FIELD

The present invention relates to a thermal head and a thermal head unit, which are used, for instance, in a miniature portable recording apparatus, a facsimile machine, a printer for tickets and receipts, etc.

BACKGROUND ART

A thermal head includes a head chip in which heat generating elements arrayed in a row and electrodes connected to these elements are provided on a ceramic substrate, and an IC chip serving as a driver for outputting print signals to selectively generate heat from desired heat generating elements at desired timings.

FIG. 9 shows an example of a thermal head unit in which the thermal head of this type is mounted onto a heat radiating plate to form a unit. The thermal head unit includes a thermal head 101, and a heat radiating plate 102 made of aluminum or the like. The thermal head 101 is designed such that an electrode 104 and a heat generating element 105 are formed on a ceramic substrate 103, and an IC chip 106 is further mounted thereon. The electrode 104, a separately provided external terminal 107 for inputting external signals therein, and the IC chip 106 are connected together through bonding wires 108. The IC chip 106 and the bonding wires 108 are molded with sealing resin 109.

Also, it known to provide a composite substrate using a ceramic substrate reduced in size. That is, as shown in FIG. 10, in place of the ceramic substrate 103, a ceramic circuit board 103A and a wiring substrate 103B such as a glass fabric based epoxy resin substrate (hereafter referred to as GE substrate when applicable) are used. In this case, the external terminal 107 is provided on the wiring substrate 103B.

A connection structure between the heat generating elements and the electrodes in the thermal head described above is classified into two types. The one type is a common electrode type in which a common electrode is provided at an end portion side where the heat generating elements on the ceramic substrate are arrayed. In this type, a segment electrode, which extends from a heat generating element corresponding to a print dot, is elongated to the other end portion of the ceramic substrate, and drawing wirings, which extends from both end portion of the common electrodes, are also elongated to the other end portion of the ceramic substrate. The other type is a so-called U-turn electrode type. That is, a pair of heat generating elements are provided correspondingly to a print dot, and one end portions of these heat generating elements are connected to each other through a U-shaped wiring. Further, one of the heat generating elements is connected to a segment electrode elongated to the end portion of the ceramic substrate, whereas the other one of the heat generating elements is connected to a common electrode provided at the end portion of the ceramic substrate. In either of the types, the common electrode are connected through external terminals, and the voltage is applied selectively to the respective segment electrodes through the IC chip.

In the thermal head of either of the types as described above, however, the common electrode is elongated in the array direction of the heat generating elements, and in general, both end portions of the common electrode are connected. Consequently, the electric resistance possessed by the common electrode causes variation in value of current flowing through the respective heat generating elements. That is, the value of current flowing through the heat generating element located at a central portion remote from the grounded portion of the common electrode is small to make the generated heat amount small, thereby causing variation in print density.

It is conceivable to make larger the width of the common electrode on the ceramic substrate to make the electric resistance of the common electrode small, thereby suppressing the print density variation. However, this is in contradiction to a demand of making the thermal head compact in size. That is, the ceramic substrate is made larger, and thus the entire thermal head is made larger.

Accordingly, in view of the problem described above, the present invention is intended to provide a thermal head and a thermal head unit, which can prevent print density variation while suppressing the size of the thermal head to be small.

DISCLOSURE OF THE INVENTION

A first aspect of the present invention relates to a thermal head comprising a head chip having one surface on which heat generating elements and individual segment electrodes and individual common electrodes connected to the heat generating elements are provided, and a semiconductor integrated circuit connected to the segment electrodes, the thermal head characterized in that an elongated common electrode connected to the individual common electrodes is provided on the head chip and is elongated in an array direction of the heat generating elements, and connections between the elongated common electrode and external terminals are provided at plural locations along the array direction.

A second aspect of the present invention relates to a thermal head, characterized in that the heat generating elements are arrayed on one end potion of the head chip, and the elongated common electrode is provided on the opposite end along the array direction of the heat generating elements.

A third aspect of the present invention relates to a thermal head, characterized in that a circuit board on which the semiconductor integrated circuit is mounted in joined to the head chip, and common electrode wiring patterns are provided to the circuit board for connecting the elongated common electrode to the external terminals.

A fourth aspect of the present invention relates to a thermal head according to the third aspect of the invention, characterized in that connection wires for connecting the common electrode to the common electrode wiring patterns are provided between physical blocks defined by the semiconductor integrated circuits.

A fifth aspect of the present invention relates to a thermal head according to the fourth aspect of the invention, characterized in that connection wires for connecting the common electrode to the common electrode wiring patterns are provided for the respective physical blocks defined by the semiconductor integrated circuits.

A sixth aspect of the present invention relates to a thermal head according to any one of the third to fifth aspects of the invention, characterized in that at least one connection wire for connecting the common electrode to the common electrode wiring pattern is provided within the physical block defined by the semiconductor integrated circuit.

A seventh aspect of the present invention relates to a thermal head according to any one of the third to sixth aspects of the invention, characterized in that each of the connection wires for connecting the common electrode to the common electrode wiring patterns is a bonding wire.

An eighth aspect of the present invention relates to a thermal head according to the seventh aspect of the invention, characterized in that at least part of the bonding wire extends across the semiconductor integrated circuit.

A ninth aspect of the present invention relates to a thermal head according to the seventh or eighth aspect of the invention, characterized in that at least part of the bonding wire is provided to extend through the semiconductor integrated circuit.

A tenth aspect of the present invention relates to a thermal head according to any one of the seventh to ninth aspects of the invention, characterized in that an end of at least part of the bonding wire is connected at a location between the semiconductor integrated circuits.

An eleventh aspect of the present invention relates to a thermal head according to any one of the third to sixth aspects of the invention, characterized in that each of the connection wires for connecting the common electrode to the common electrode wiring patterns is of a flip tip type.

A twelfth aspect of the present invention relates to a thermal head according to any one of the third to seventh aspects of the invention, characterized in that the semiconductor integrated circuit is of a flip tip type, which is mounted to extend across the head chip and the circuit board.

A thirteenth aspect of the present invention relates to a thermal head unit characterized in that the thermal head according to any one of the first to twelfth aspects of the invention is mounted to a support member.

BEST MODE FOR CARRYING OUT THE PRESENT INVENTION

Hereafter, the present invention will be described in detail with reference to embodiments thereof.

FIRST EMBODIMENT

Figure 1:
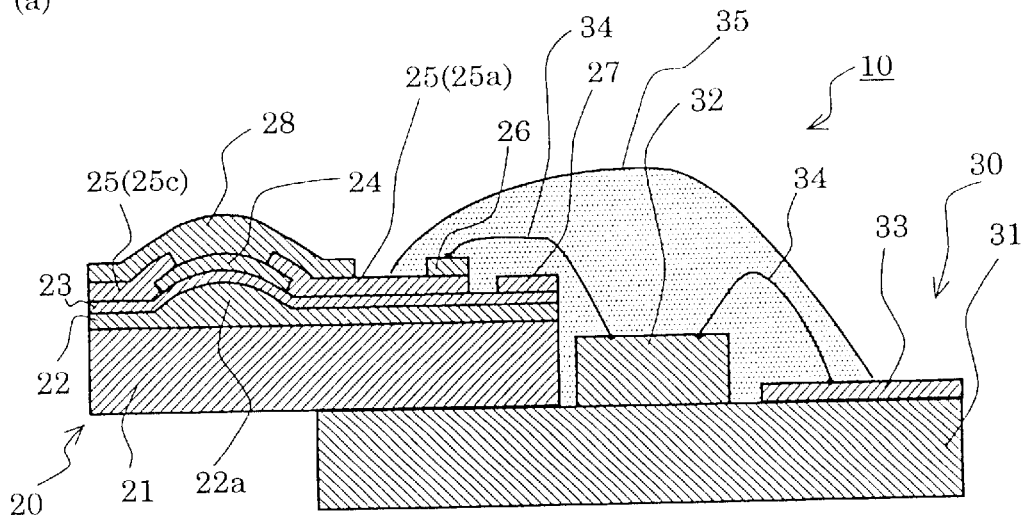
FIG. 1 is a sectional view and a plane view of a thermal head according to a first embodiment of the present invention.
Figure 1:
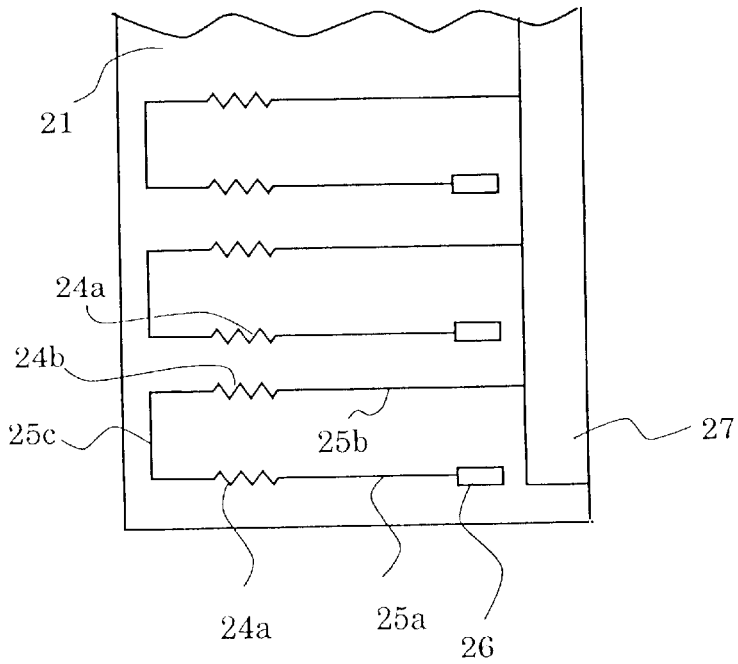

FIG. 1 is a sectional schematic view and a major portion plane view of a thermal head according to an embodiment of the present invention. As shown in FIG. 1(*a*), a thermal head 10 includes a head chip 20 formed with a plurality of thin film layers, and a wiring substrate 30 onto which the head chip 20 is stuck and joined.

The head chip 20 is arranged such that the various thin film layers are formed on a ceramic substrate 21. An under coat layer 23 and a glaze layer 22 made of a glass group material having a function of a thermally insulative layer are formed on the ceramic substrate 21. The glaze layer 22 has a protruded rib 22*a* having a semicircular shape in section, which is located at a predetermined distance from one end of the ceramic substrate 21. Formed on the area confronted with this protruded rib 22*a* are heat generating elements 24 intermittently arranged at predetermined intervals in the longitudinal direction thereof. Electrodes 25, made of a metal such as an aluminum, are formed to contact end portions (left and right end portions in the drawing) of the respective heat generating elements 24 of the ceramic substrate 21. Further, a protective layer 28 is formed on the heat generating elements 24.

Here, each of the heat generating elements 24 is made up of a pair of heat generating elements 24*a* and 24*b*, and electrodes 25*a* and 25*b* are connected to respective end portions of the heat generating elements 24*a* and 24*b*. The electrode 25*a* serves as a segment electrode, and the end portion thereof is connected to a terminal portion 26, for instance, made of a gold thin film layer. The electrode 25*b* serves as a common electrode, which is connected to a common electrode 27 that is located on an end portion of the substrate opposite from the heat generating elements 24. Further, the other end portions of the heat generating elements 25*a* and 25*b* are connected to each other through an electrode 25*c*.

The wiring substrate 30 is arranged such that IC chips 32 and external terminals 33 are provided on a substrate 31 such as a GE substrate. The IC chip 32 serves as a driver for outputting drive signals to selectively generate heat from the above heat generating elements 24. The IC chip 32 is provided for each of predetermined physical blocks of the heat generating elements 24. The external terminal 33 serves to input external signals into the respective IC chips 32. The IC chips 32 are connected to the terminal portions 26 and the external terminals 33 through bonding wires 34, respectively. The IC chips 32 and the bonding wires 34 are molded with sealing resin 35.

The thermal head 10 described above is arranged such that the head chip 20 and the wiring substrate serving as a support substrate for the head chip 20 are partially overlapped and jointed to each other so that the head chip 20 is mounted on the wiring substrate 30. Accordingly, the width (in the right and left direction in the drawing) of the head chip 20 can be remarkably reduced, and therefore the number of the head chips 20 obtained during the board forming process can be increased to improve the productivity. Further, since the head chip 20 and the wiring substrate 30 can be handled in a state that they are joined to each other, the handling ability during the IC chip 32 mounting process is not lowered. In this case, as described in detail later, the handling ability can be further remarkably increased if the IC chip 32 mounting process and the wire bonding are carried out such that a plurality of head chips 20 are jointed onto a wiring substrate forming plate from which a plurality of wiring substrates 30 can be dividingly obtained.

Further, the thermal head according to the present embodiment uses the common electrode 27 of the width which is suppressed to the minimal level in order to make the width of the ceramic substrate 21 the smallest as well as improves the connection of the common electrode 27 to the external terminals in order to eliminate the variations in print density among the heat generating elements 24.

Figure 2:
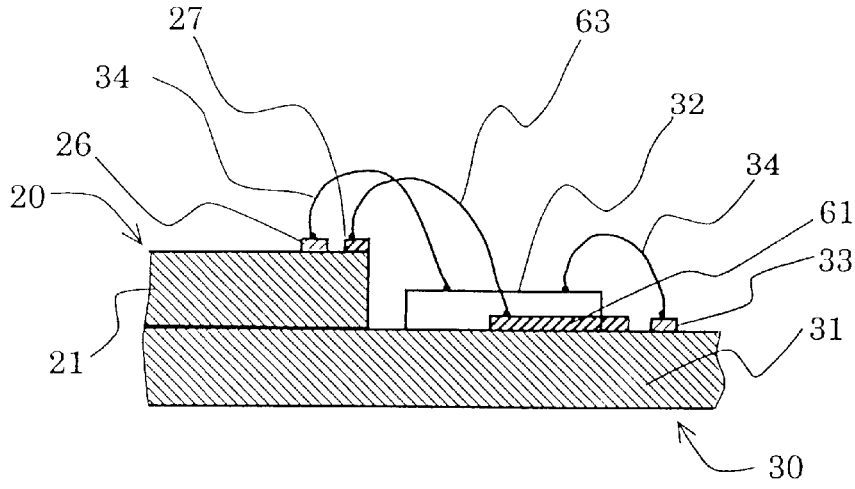
FIG. 2 is a sectional view and a plane view of a wiring connecting portion between a head chip and a wiring substrate in the thermal head according to the first embodiment of the present invention.
Figure 2:
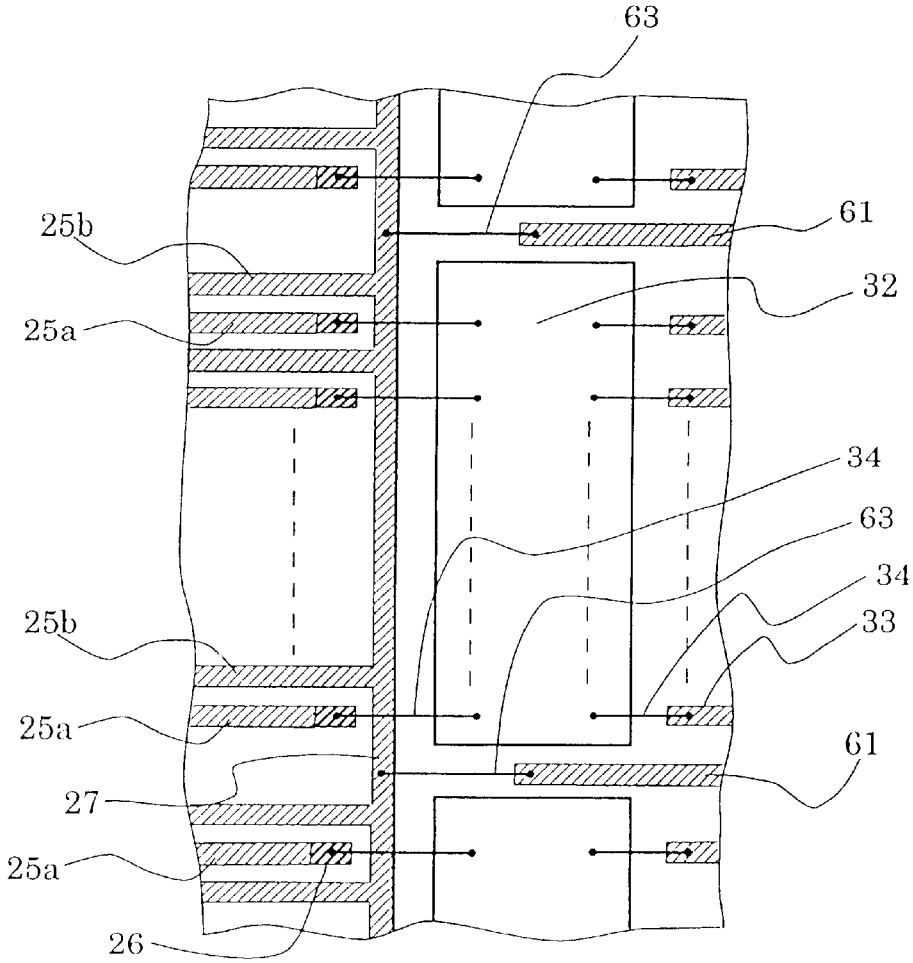

FIG. 2(*a*) is a sectional view of a wiring connecting portion between the common electrode 27 of the head chip 20 and the common electrode wirings of the wiring substrate 30, and FIG. 2(*b*) is a plane view thereof.

As shown in these drawings, the wiring substrate 30 is provided with the common electrode wirings 61 so that the common electrode wirings 61 extend to the area between the adjacent IC chips 32, and these common electrode wirings 61 and the common electrode 27 provided to the end portion of the ceramic substrate 21 are connected through the bonding wires 63, respectively. Each of the common electrode wirings 61 is grounded through an unillustrated external terminal. That is, in the present embodiment, the common electrode 27 is connected to the common electrode wiring 61 of the wiring substrate 30 at each of physical blocks defined by the respective IC chips 32.

Accordingly, since the connection between the common electrode 27 and the common electrode wiring 61 of the wiring substrate 30 is provided at each of the physical blocks defined by the respective IC chips 32, it is possible to reduce the variation in print density caused due to the electric resistance of the common electrode 27. That is, it is possible to reduce the variation in value of current flowing through the heat generating elements, to thereby make uniform the quantity of the heat generated from the heat generating elements.

Figure 3:
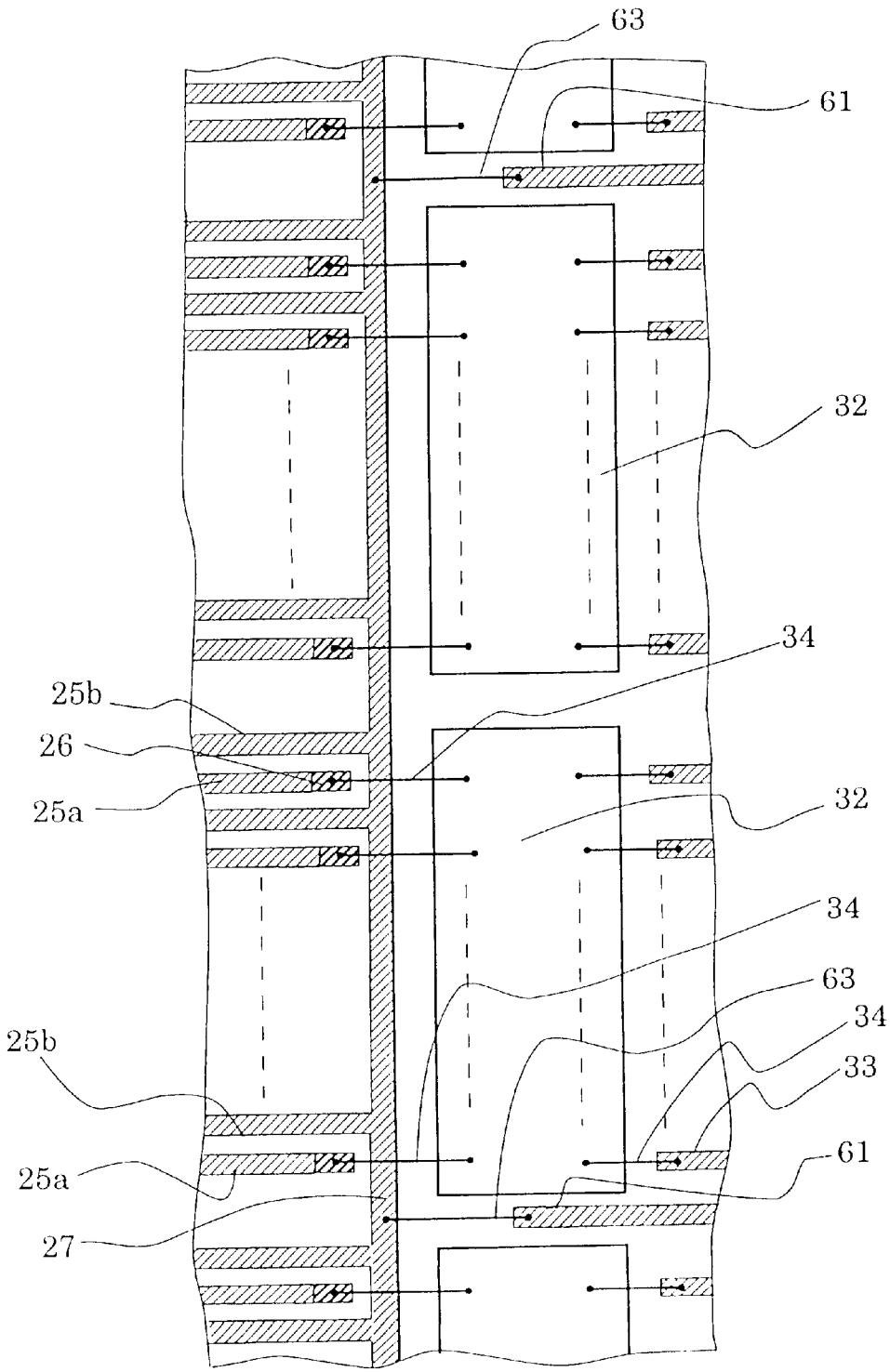
FIG. 3 is a plane view of the wiring connecting portion between the head chip and the wiring substrate, illustrating a modified example according to the first embodiment of the present invention.

The number of the common electrode wirings 61 can be determined based on the electric resistance of the common electrode 27, the voltage applied during printing, the number of the heat generating elements connected to the IC chip 32, the electric resistance of the heat generating element, etc. For example, as shown in FIG. 3, each of the common electrode wirings 32 may be provided for two of the IC chips 32, or multiple, i.e., three or more IC chips 32.

The thermal head 10 described above is used such that it is held on a support member, that is made of a metal such as an aluminum and that has a function of a heat radiating plate, to form a thermal head unit. An example of the thermal head unit is shown in FIG. 4.

Figure 4:
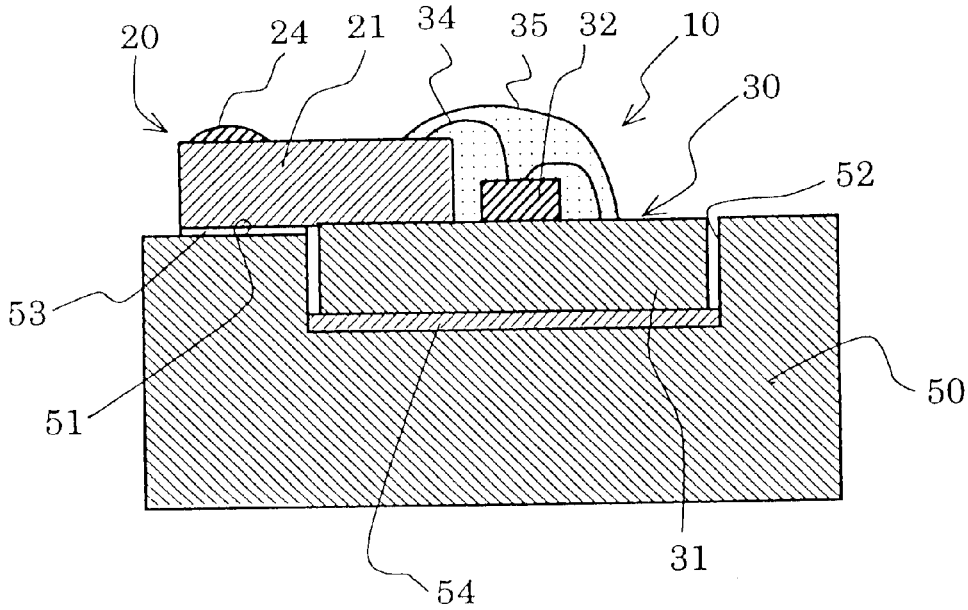
FIG. 4 is a sectional view of a thermal head unit according to the first embodiment of the present invention.

As shown in FIG. 4, a support member 50 includes an upper step portion 51 serving as a head chip supporting portion which is closely contacted with the reverse side of a heat generating element forming portion of the head chip 20 which is protruded from the wiring substrate 20 and which is provided with the heat generating elements 24, and a step difference portion 52 recessed more deeply than the thickness of the wiring substrate 30. The protruded portion of the head chip 20 is firmly fixed to the upper step portion 51 with an adhesive layer 53, and a bottom portion of the step difference portion 52 is provided with an adhesive agent layer 54. With this arrangement, the support member 50 and wiring substrate 30 are firmly fixed to each other through the adhesive agent layer 54, and the support member 50 and the head chip 20 are firmly fixed to each other through the adhesive layer 53.

SECOND EMBODIMENT

Figure 5:
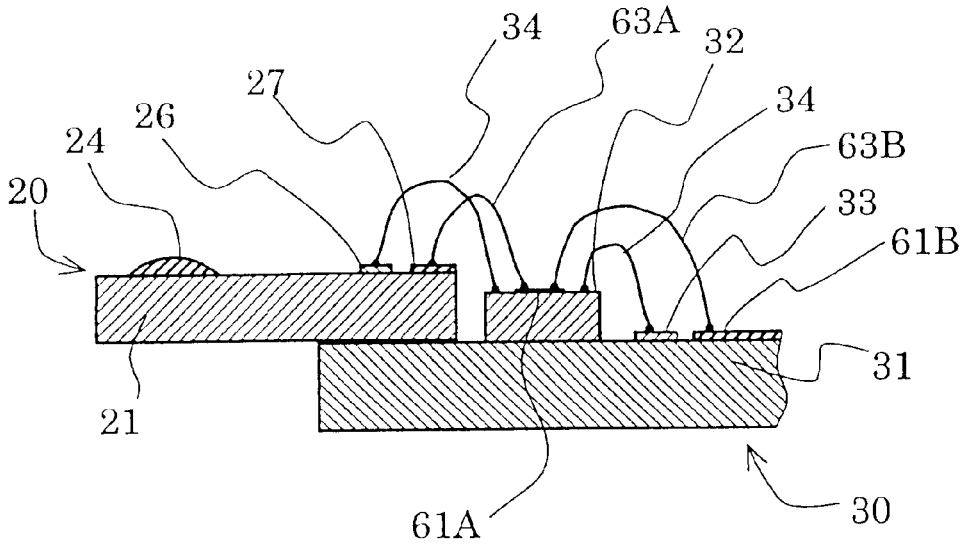
FIG. 5 is a sectional view of the wiring connecting portion between the head chip and the wiring substrate in the thermal head according to a second embodiment of the present invention.

FIG. 5 is a sectional view of a wiring connection portion between a head chip and a wiring substrate in a thermal head according to a second embodiment of the present invention.

In this embodiment, plural connections between the common electrode 27 of the ceramic substrate 21 and the common electrode wirings 61B of the wiring substrate 30 are provided within each physical block. That is, in the present embodiment, further provided are a common electrode wiring 61A on the substantially central portion of the IC chip 32, and a common electrode wiring 61B associated therewith, and bonding wires 63A and 63B respectively connecting the common electrode 27 to the common electrode wiring 61A and the common electrode wiring 61A to the common electrode wiring 61B. Other arrangements are the same as those of the embodiment described above. In addition to the connection between the common electrode 27 and the IC chip 32, the connection is provided at the substantially longitudinal central portion of the IC chip 32 between the common electrode 27 and the common electrode wiring 61A. This makes it possible to further suppress the non-uniformity of value of current flowing through each of the heat generating elements, to thereby further reduce variation in print density.

The number of common electrode connections provided within each physical block, the location of each connection, and a connecting manner are not specifically limited. The same effect can be obtained if a plurality of connections are provided within each physical block.

Figure 6:
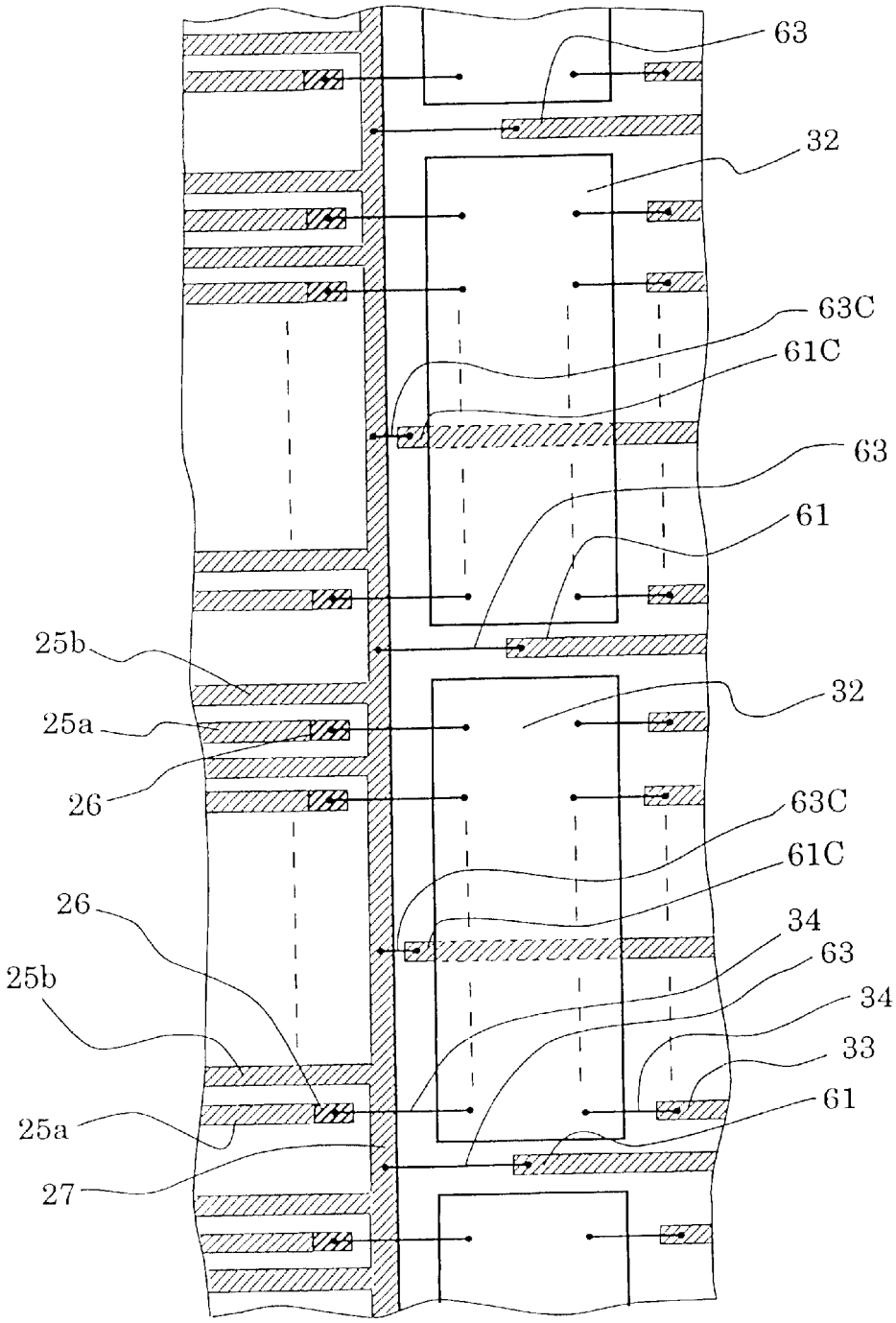
FIG. 6 is a plane view showing a modified example according to the second embodiment of the present invention.

For example, as shown in FIG. 6, the connection within each physical block may be carried out using a common electrode wiring 61C provided below the IC chip 32 and a bonding wire 63C in place of using the common electrode wiring 61A provided on the surface of the IC chip 32. In this case, it is possible to facilitate the wire bonding and shorten the length of the bonding wire.

Figure 7:
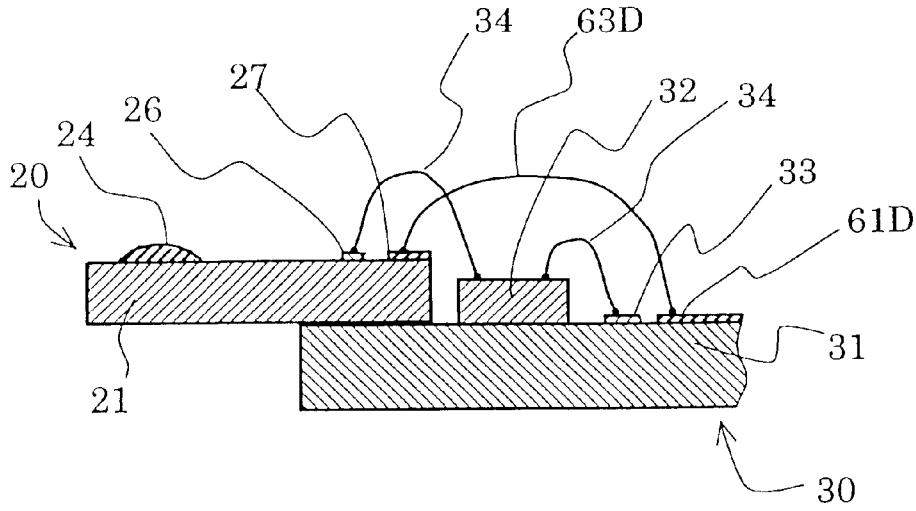
FIG. 7 is a sectional view showing a modified example according to the second embodiment of the present invention.

As shown in FIG. 7, a common electrode wiring 61D provided opposite from the common electrode 27 with respect to the IC chip 32 may be connected to the common electrode 27 through a bonding wire 63D extending across the IC chip 32. This case is advantageous in that a processing for providing the common electrode wiring on the IC chip 32 or the like is unnecessary.

ANOTHER EMBODIMENT

In the embodiments described above, the thermal head is constructed such that the head chip 20 and wiring substrate 30 are partially overlapped and joined to each other. Of course, the present invention is not limited thereto, and the present invention is applicable to a thermal head which does not have the wiring substrate and which has the ceramic substrate mounting the IC thereon, and also to the connection between the common electrode provided on the ceramic substrate and the external terminal provided, for instance, on the support member.

Further, in the embodiments described above, the connection between the common electrode and the common electrode wiring is carried out using the wire bonding, but of course, the present invention is not limited thereto. The connection is not specifically limited as far as it can establish the electrical connection.

Figure 8:
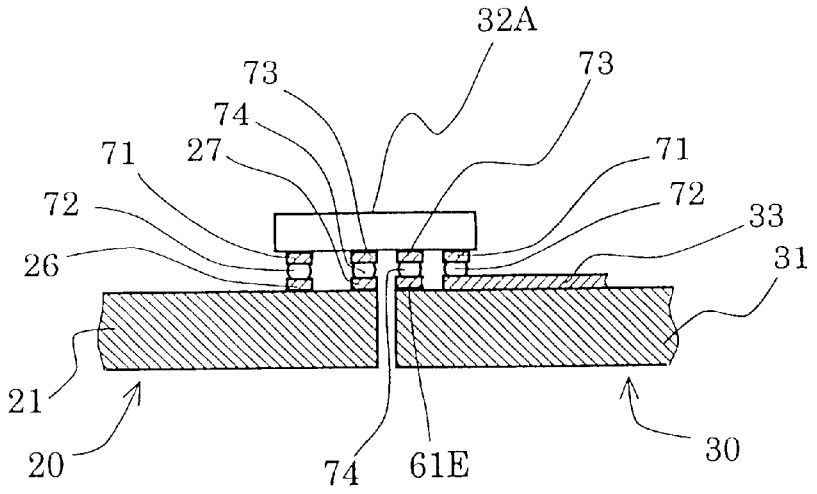
FIG. 8 is a sectional view and a plane view of the wiring connecting portion between the head chip and the wiring substrate in the thermal head according to another embodiment of the present invention.
Figure 8:
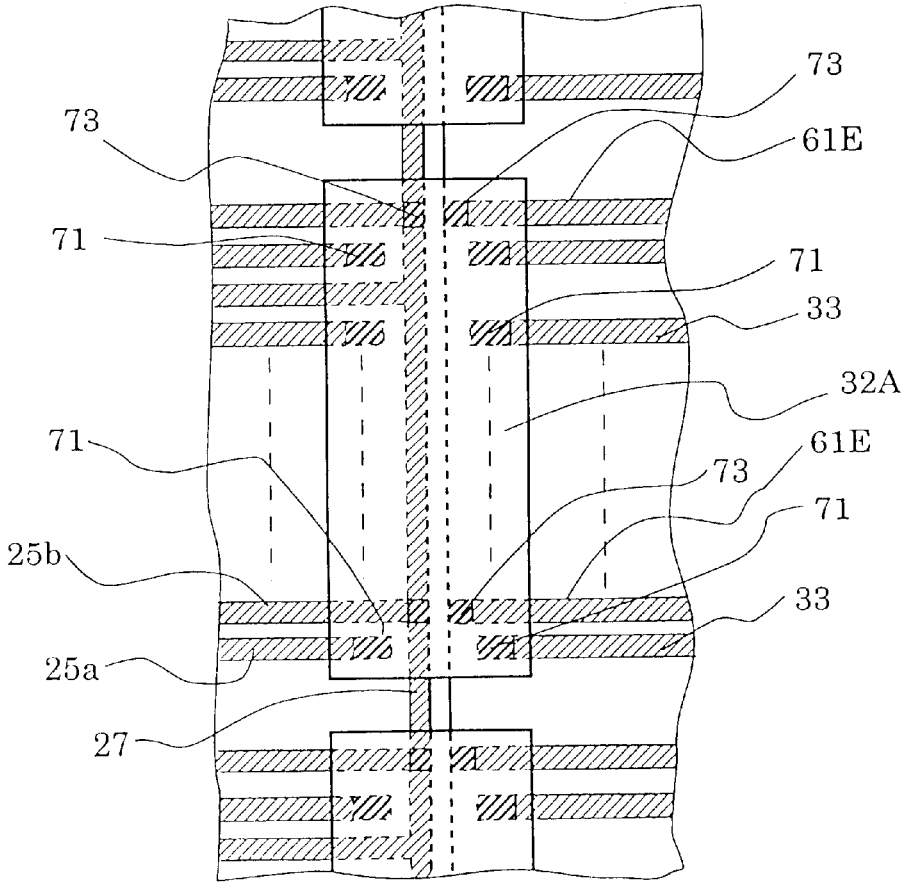
Figure 9:
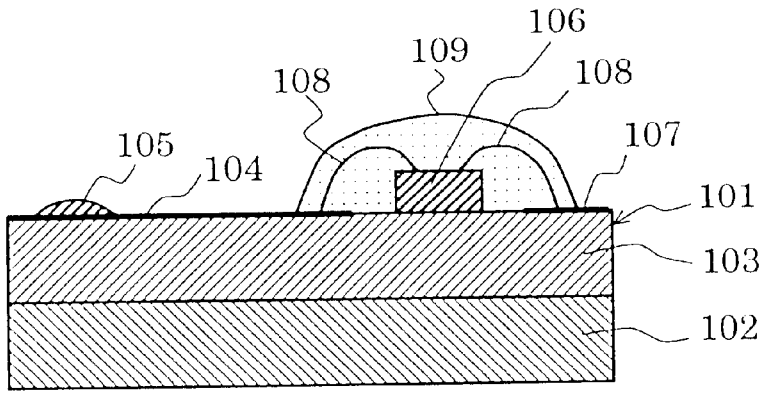
FIG. 9 is a sectional view of a thermal head according to a conventional art.
Figure 10:
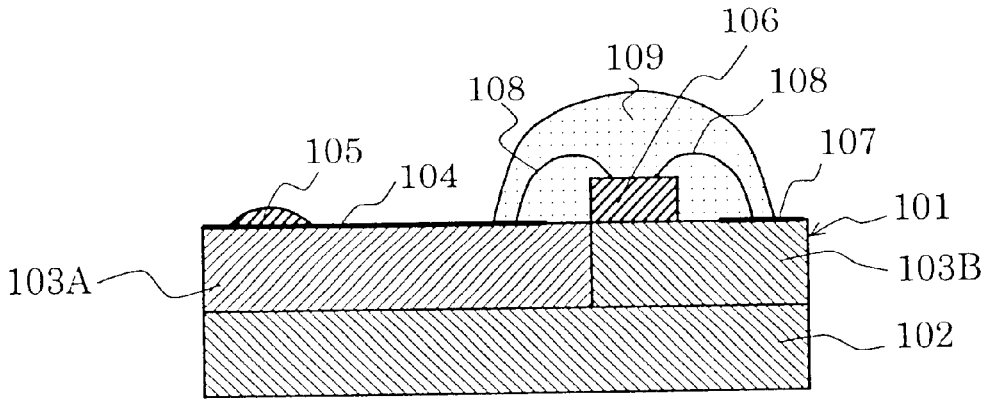
FIG. 10 is a sectional view of a thermal head according to a conventional art.

FIGS. 8(*a*) and 8(*b*) are a sectional view and a plane view of a wiring connecting portion between the head chip and the wiring substrate in a thermal head according to another embodiment.

In the present embodiment, the height of the head chip 20 is substantially the same as the height of the wiring substrate 30, and a semiconductor integrated circuit 32A of a flip tip type are mounted onto and across the head chip 20 and the wiring substrate 30.

The terminal portion 26 on the segment electrode 25*a* connected to the heat generating element is connected to the external terminal 33A through a pad 71 and a bump 72 provided on the lower surface of the IC chip 32A. The IC chip 32A is provided with pads 73 short-circuited to each other for common electrode wirings, and these pads 73 are respectively connected through bumps 74 to the common electrode 27 and the common electrode wiring 61E on the wiring substrate 30. The use of the IC chip 32A of the flip tip type in this manner can dispense with the connection by the wire bonding.

Of course, the wire bonding may be used for connection between the common electrode and the common electrode wiring within the IC chip of the flip tip type.

Further, in the embodiments described above, the discussion has been made with respect to the connection in the so-called U-turn electrode type, but the present invention is applicable to the connection in the common electrode type. That is, by providing the connection of the common electrode on the heat generating element side through the external terminal at a location or locations other than the both end portions of the common electrode, the print density variation can be reduced.

Industrial Applicability

As described above, according to the present invention, connections between the common electrode and external terminals of the head chip are made at plural locations along the array direction of the heat generating elements. Accordingly, it is effective in that it is possible to keep the thermal head compact in shape to reduce the variation in print.

What is claimed is:

1. A thermal head comprising: a substrate; a plurality of heat generating elements formed on the substrate and arranged in an array along a row; a segment electrode formed on the substrate for each of the heat generating elements; an individual common electrode formed on the substrate for each of the heat generating elements; one or more semiconductor integrated circuits connected to a plurality of the segment electrodes, each integrated circuit for driving plural heat generating elements; an elongated common electrode extending in the direction of the array of heat generating elements and being connected to each of the individual common electrodes; and a plurality of common electrode wiring patterns for connecting the elongated common electrode to an external connection terminal, the common electrode wiring patterns being disposed at plural locations in the direction of the array of heat generating elements; further comprising a circuit board on which the integrated circuits are provided; and wherein a plurality of the common electrode wiring patterns are provided on the circuit board in the direction of the array for connecting the elongated common electrode to the external connection terminal.

2. A thermal head according to claim 1; wherein the head chip is adhered to and partially overlaps the circuit board.

3. In a thermal head having a head chip on which are disposed a plurality of heat generating elements, a plurality of segment electrodes and a plurality of common electrodes connected to the heat generating elements, and a circuit board on which a plurality of semiconductor integrated circuits are provided each for driving plural heat generating elements, the improvement comprising: the circuit board on which the semiconductor integrated circuits are mounted is joined to the head chip; an elongated common electrode connected to each of the respective common electrodes is provided on the head chip, and common electrode wiring patterns are provided on the circuit board at plural locations along a direction of the elongated common electrode for connecting the elongated common electrode to an external connection terminal.

4. A thermal head according to claim 3; wherein the semiconductor integrated circuits are spaced apart from each other along a row in the direction of the elongated common electrode; and the common electrode wiring patterns for connecting the elongated common electrode to the external connection terminal are each provided on the circuit board between physical blocks defined by the semiconductor integrated circuits.

5. A thermal head according to claim 4; wherein the common electrode wiring patterns for connecting the elongated common electrode to the external connection terminal are provided on selected semiconductor integrated circuits.

6. A thermal head according to claim 3; wherein at least one common electrode wiring pattern for connecting the elongated common electrode to the external connection terminal is provided within a physical block defined by the semiconductor integrated circuit.

7. A thermal head according to claim 3; wherein each of the common electrode wiring patterns is connected to the common electrode by a bonding wire.

8. A thermal head according to claim 7; wherein the binding wires extend across the semiconductor integrated circuits.

9. A thermal head according to claim 7; wherein the binding wires extend through the semiconductor integrated circuits.

10. A thermal head according to claim 7; wherein an end of at least some of the bonding wires is connected to a common electrode wiring pattern at a location between semiconductor integrated circuits.

11. A thermal head according to claim 3; wherein each of the common electrode wiring patterns for connecting the elongated common electrode to the external connection terminal is of a flip tip type.

12. A thermal head according to claim 3; wherein each semiconductor integrated circuit is of a flip tip type, and is mounted to extend across the head chip and the circuit board.

13. A thermal head according to claim 3; further comprising a support member for supporting the head chip and the circuit board.

14. A thermal head according to claim 3; wherein the head chip partially overlaps the circuit board.

15. A thermal head comprising: a head chip having a ceramic substrate, a plurality of heat generating elements formed on the ceramic substrate and arranged in a row, and individual electrodes formed on the ceramic substrate and connected to the heat generating elements; a circuit board having an external connection terminal, and a plurality of IC chips each for driving a plurality of the heat generating elements by outputting print signals to selectively generate heat from selected heat generating elements at desired timings; an elongated common electrode provided on the head chip extending in the direction of the row and being connected to individual electrodes of each of the heat generating elements; and common electrode wiring patterns connected at first ends to an external connection terminal and at second ends to the elongated common electrode.

16. A thermal head according to claim 15; wherein the head chip further comprises a glaze layer provided on the ceramic substrate and having projections arranged along the row at predetermined intervals and extending upward from the ceramic substrate at a predetermined distance from an edge of the ceramic substrate, an undercoat layer of a thermally insulative glass material provided on the glaze layer, and a protective layer provided on the heat generating elements; wherein the respective heat generating elements are formed on the projections.

17. A thermal head according to claim 15; wherein each of the heat generating elements comprises a pair of adjacent heat generating elements electrically connected at first ends, and the individual electrodes comprise an individual common electrode connected to a second end of one of the pair of heat generating elements and a segment electrode connected to a second end of the other one of the pair of heat generating elements.

18. A thermal head according to claim 15; wherein the head chip is adhered to and partially overlaps the circuit board.

* * * * *